United States Patent [19]

Hauslaib et al.

[11] Patent Number: 5,061,096

[45] Date of Patent: Oct. 29, 1991

[54] DEVICE FOR TRANSPORT OF MULTI-LAYER, EDGE-PERFORATED IMPRINT-RECEIVING SUBSTRATES

[75] Inventors: Wolfgang Hauslaib, Langenau; Günter Gomoll, Nersingen; Ulrich Buschmann, Elchingen, all of Fed. Rep. of Germany

[73] Assignee: Mannesmann Aktiengesellschaft, Düsseldorf, Fed. Rep. of Germany

[21] Appl. No.: 619,064

[22] Filed: Nov. 27, 1990

[30] Foreign Application Priority Data

Nov. 27, 1989 [DE] Fed. Rep. of Germany ..... 3939507

[51] Int. Cl.[5] ..... B41J 11/26

[52] U.S. Cl. ..... 400/616.2; 400/618; 226/6; 226/74

[58] Field of Search ..... 400/616, 616.1, 616.2, 400/616.3, 617, 618; 226/6, 52, 59, 74, 82, 86

[56] References Cited

U.S. PATENT DOCUMENTS

| | | | |
|---|---|---|---|
| 3,746,142 | 7/1973 | Hepp et al. | 400/618 |
| 4,804,124 | 2/1989 | Hirth et al. | 400/616.2 |
| 4,807,792 | 2/1989 | Tajima et al. | 226/74 |
| 4,817,842 | 4/1989 | Wilson, III | 400/616.2 |
| 4,896,980 | 1/1990 | Sanders, Jr. et al. | 400/618 |
| 4,952,087 | 8/1990 | Iwata et al. | 400/616.1 |
| 4,989,771 | 2/1991 | Ferguson | 226/74 |
| 4,990,010 | 2/1991 | Mizutawi | 400/616.2 |

FOREIGN PATENT DOCUMENTS

| | | | |
|---|---|---|---|
| 2601291 | 1/1988 | France | 400/616.2 |

*Primary Examiner*—Eugene H. Eickholt

*Attorney, Agent, or Firm*—Horst M. Kasper

[57] ABSTRACT

A device for the transport of multilayer, edge-perforated imprint-receiving substrates (8) takes into consideration a curve-shaped transport path (9), wherein a thrust tractor pair (5) is disposed in front and ahead of a substrate support (2), as seen in transport direction (10). Several friction roller pairs are following to the thrust tractor pair (5). In each case, a pulling force is transferrable by way of at least one friction roller. The multilayer imprint-receiving substrate (8) rests with its rear layer (8*a*) on the substrate support (2). A tearing of the edge perforations of the imprint-receiving substrate (8) as well as belly and bulge formations of one of the two layers (8*a*, 8*b*) is avoided by furnishing the push tractor (5) with a braking element (19) for the front layer (8*b*). A following first friction roller pair (11) rests with a driven friction roller (11*a*) at the front layer (8*b*). This friction roller (11*a*) performs a slightly smaller motion path per time unit relative to the counter friction roller (11*b*). However, the counter friction roller (11*b*), resting at the rear layer (8*a*), performs a slightly larger motion path relative to the tractor advance path.

20 Claims, 4 Drawing Sheets

DEVICE FOR TRANSPORT OF MULTI-LAYER, EDGE-PERFORATED IMPRINT-RECEIVING SUBSTRATES

BACKGROUND OF THE INVENTION

1. Field of the Invention

The invention relates to a device for the transport of multilayer, edge-perforated imprint-receiving substrates, which are movable along a curved transport path, with a thrust tractor pair disposed in front of a substrate support in transport direction, as well as with at least one friction roller pair with respectively at least one driven friction roller, where a pulling force can be transferred by way of the driven friction roller, and wherein the multilayer imprint-receiving substrate rests with its rear layer on the substrate support.

2. Brief Description of the Background of the Invention Including Prior Art

Such devices can be distinguished from other conventional devices, where only a single-layer sheet paper is processed by the necessary structural changes for balancing the generally unequal pull exerted onto the front or the rear layers of the multilayer imprint-receiving substrate.

Different radii of the front and rear layer and thus a differently extended paper length result during the transport of multilayer paper through a curve-shaped channel. A pulling force is exerted onto the multilayer form paper during operation with a thrust tractor along the straight path of the transport. In case of a deficient connection of the form packages relative to each other, there can occur various malfunctions of the equipment including jamming and erroneous and defective operations. The pulling force on the front layer is so large that this layer migrates upwardly at the pin of the tractor gear belt and possibly tears the paper. The imprint-receiving substrate then skips and slides out of the thrust tractor. In the other case, where the pulling force onto a rear layer is too low, there is formed a bulge ahead of a friction roller pair disposed following the thrust tractor, i.e. the paper becomes curved and causes a paper jamming during the further course of the transport motion.

It is known to transport single-layer paper over a curved transport path as taught, for example, in the German Patent document DE 3,607,080. The known structure is suitable for individual sheets and for continuous paper bands. It is however of major importance in this connection that already advanced imprint-receiving substrates are also withdrawn again from a joint feed channel, in order to hold one or the other imprint-receiving substrate in waiting position. In this regard, however, the thrust tractor is nevertheless of importance in this context in that the thrust tractor feeds and advances the imprint-receiving substrate resting tightly on a press-on bar. As long as the tip of the imprint-receiving substrate lies only on the press-on bar, no pulling force is generated within the imprint-receiving substrate. Such a device consequently does not readily take into consideration a multilayer imprint-receiving substrate.

For example, multilayer imprint-receiving substrates comprise a thicker "front" original sheet and one or several thinner "rear" sheets made of so-called copy paper. According to this definition, the thicker front original sheet is disposed at the bottom side of the thrust tractor, whereas the thinner copy paper is disposed at the upper side of the thrust tractor, i.e. immediately under the conventional flip cover for the thrust tractor.

SUMMARY OF THE INVENTION

1. Purposes of the Invention

It is an object of the present invention to transport a multilayer edge-perforated imprint-receiving substrate under a substantially uniform pull exerted on all layers by way of a thrust tractor.

It is another object of the present invention to provide a thrust tractor construction which avoids different pulling forces on the different paper layers of an imprint-receiving substrate.

It is yet a further object of the present invention to construct a paper feed for multilayer imprint-receiving substrates, which substantially avoids a jamming of the paper.

These and other objects and advantages of the present invention will become evident from the description which follows.

2. Brief Description of the Invention

The present invention provides for a device for the transport of multilayer, edge-perforated imprint-receiving substrates. A thrust tractor pair for pushing the multilayer edge- perforated imprint-receiving substrate is movable along a curved transport path. A braking element is furnished at the thrust tractor for braking a front layer of the multilayer imprint receiving substrate. A first friction roller is driven by a motor and rests against the front layer of the multilayer imprint-receiving substrate. A second friction roller rests against a rear layer of the multilayer imprint-receiving substrate and provides a counter friction roller. The first friction roller and the second friction roller form a friction roller pair including at least one driven friction roller for transferring a pulling force to the multilayer imprint-receiving substrate arriving from the thrust tractor pair. The first friction roller surface performs a slightly smaller motion path with its surface engaging the front layer of the imprint-receiving substrate per time unit relative to an advance of the thrust tractor advance motion. The second friction roller surface, resting at the rear layer of the imprint-receiving substrate, performs a slightly larger motion path versus the tractor advance motion. The multilayer imprint-receiving substrate, arriving from the friction roller pair, rests with its rear layer on the substrate support.

The first friction roller surface can perform a motion path with its surface, engaging the front layer of the imprint-receiving substrate per time unit. Said motion path can be from about one to three percent smaller relative to the thrust tractor advance motion. The second friction roller surface, resting at the rear layer of the imprint-receiving substrate, can perform a motion path from about one to three percent larger than the tractor advance motion path.

A print head can be disposed adjacent to the front layer of the multilayer imprint-receiving substrate immediately opposite to the substrate support.

The front layer of the multilayer imprint-receiving substrate, arriving from the print head, can contact a surface of the third friction roller. The rear layer of the multilayer imprint receiving substrate, arriving from the substrate support, can contact a surface of the fourth friction roller. The third friction roller and the fourth friction roller can form a friction roller pair.

A flip cover for the thrust tractor can be disposed next to the rear layer of the multilayer imprint-receiving substrate. The braking element, furnished at the thrust tractor for braking the front layer of the multilayer imprint-receiving substrate, can exert a braking force which is at least two times the braking force generated by the flip cover on the rear layer of the multilayer imprint-receiving substrate.

In another embodiment of the invention, the device for the transport of multilayer, edge-perforated imprint-receiving substrates comprises a flip cover having a support face for a rear layer of a multilayer imprint-receiving substrate. The flip cover is furnished smooth at said support face and exhibits an opening recess. A thrust tractor includes at least one driven gear wheel and is closable by the flip cover and exhibits a rough braking face disposed opposite the closed flip cover. The flip cover is pressable onto the rear layer of the passing imprint-receiving substrate. An endless gear belt is guided and lead over the driven gear wheel. The gear belt is furnished with pins on the outside for an engagement into the imprint-receiving substrate. The opening recess of the flip cover surrounds the pins. The thrust tractor can form a rigid guide channel disposed behind the flip cover. This rigid guide channel can range beyond the engagement path of the gear belt. The thrust tractor can be curved for deflecting the path direction of the multilayer imprint-receiving substrate. The flip cover can be adapted to the curvature of a tractor body with engaged gear belt. Friction engagement means can be disposed in the braking face of the thrust tractor, furnishing roughness and disposed aligned for extending longitudinally in a direction perpendicular to the transport advance direction of the imprint-receiving substrate. The rough braking face of the thrust tractor, for braking the front layer of the multilayer imprint-receiving substrate, can exert a braking force which is at least two times the braking force generated by the flip cover on the rear layer of the multilayer imprint-receiving substrate.

A method for the transport of multilayer, edge-perforated imprint-receiving substrates comprises the following steps: The multilayer imprint-receiving substrate is pushed with a thrust tractor pair along a curved transport path. A front layer of the multilayer imprint-receiving substrate is braked with a braking element furnished at the thrust tractor. A first friction roller is driven with a motor. The front layer of the multilayer imprint-receiving substrate arriving from the thrust tractor is advanced with the first friction roller. A second friction roller providing a counter friction roller is pressed against a rear layer of the multilayer imprint-receiving substrate, while the first friction roller and the second friction roller form a friction roller pair. The friction roller pair includes at least one driven friction roller for transferring a pulling force to the multilayer imprint-receiving substrate arriving from the thrust tractor pair. The first friction roller surface performs a slightly smaller motion path with its surface engaging the front layer of the imprint-receiving substrate per time unit relative to an advance of the thrust tractor advance motion The second friction roller surface resting at the rear layer of the imprint-receiving substrate performs a slightly larger motion path versus the tractor advance motion. The multilayer imprint-receiving substrate is guided from the friction roller pair to a substrate support. The multilayer imprint-receiving substrate arriving from the friction roller pair contacts the substrate support with its rear layer.

According to the present invention, the thrust tractor is furnished with a braking element for the front layer of the multilayer imprint-receiving substrate. A friction roller pair following the thrust tractor exhibits a driven friction roller, which rests at the front layer of the multilayer imprint-receiving substrates and which performs a smaller motion path per time unit relative to the counter-friction roller. However, the counter-friction roller, resting at the rear layer of the imprint-receiving substrate, performs a slightly larger motion path relative to the thrust tractor advance. The pulling forces thereby generated are advantageously properly adjusted to the inwardly and outwardly disposed layers of the imprint-receiving substrates such that individual, and in particular rear layers are subjected only to a slight bulge formation and such that other layers are not overstressed, overstrained, or overloaded at the pinfeed perforations and in the thrust tractor such that the perforation edge of the paper cannot be damaged.

Advantageously, the distribution of the driving forces is performed such that the thrust tractor together with the braking element is disposed in transport direction ahead of and in front of the first friction roller pair, where the substrate support follows to the first friction roller pair, and wherein a second friction roller pair is furnished behind the substrate support.

The device for the transport of multilayer, edge-perforated imprint-receiving substrates is further furnished with a push tractor. The push tractor is disposed in transport direction in front of a substrate support and is furnished with at least one driven gear wheel. An endless gear belt is lead over the driven gear wheel. The gear belt is furnished on the outside with pins for the engagement into the imprint-receiving substrate. The device is furnished with a flip cover with an opening groove for the pins.

The particular braking element is furnished by having the thrust tractor comprise a rough braking face disposed opposite to the closed flip cover. The flip cover, pressable onto the inserted imprint-receiving substrate is however furnished with a smooth contact surface. Thus, the front layer, formed in general by a thicker form sheet, is substantially braked, wherein the rough braking face can also transfer this braking force, whereas the rear layer, which is frequently a thin, weak copy paper, remains unbraked, i.e. is correspondingly not subjected to overstresses, overstrains, and overloading.

It is further an advantageous embodiment of the invention that the thrust tractor exhibits in transport direction behind the flip cover a rigid guide channel, protruding beyond the engagement path of the gear belt. Advantageously, confining guides, determining the transport direction and transport path, are thereby generated, which confining guides cannot be avoided and bypassed by the imprint-receiving substrates.

In addition, an improved engagement into the edge perforation of the imprint-receiving substrate is further generated by adapting the flip cover to the rounding of a tractor body with a gear belt resting on the tractor body.

According to an advantageous feature of the invention, the braking effect of the braking element is further enhanced in that the rough braking face exhibits grooves, teeth, or the like, running cross to the transport direction of the imprint-receiving support.

The novel features which are considered as characteristic for the invention are set forth in the appended claims The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
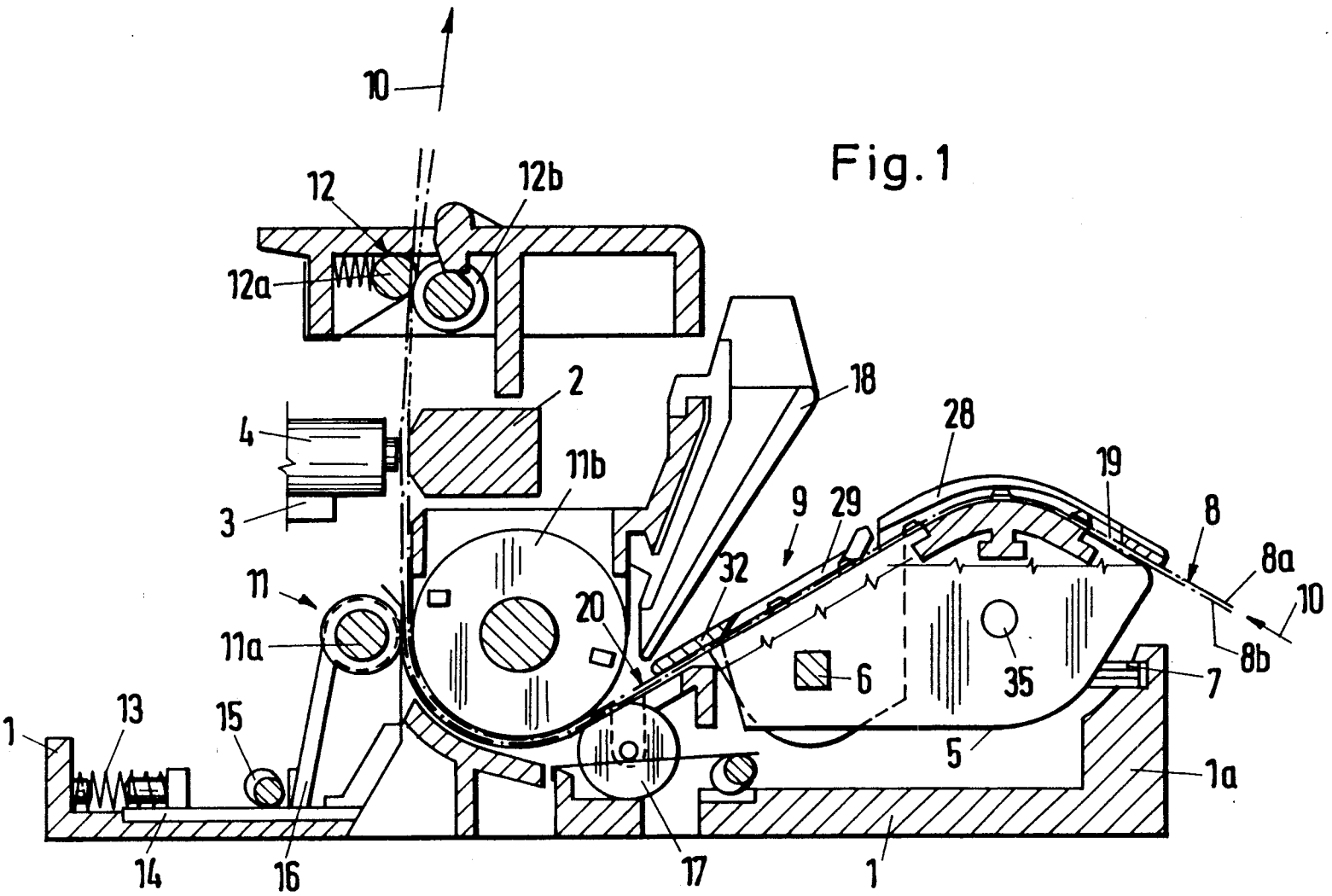
FIG. 1 is a cross-sectional view through the invention device.

According to the present invention, there is provided for a device for the transport of multilayer, edge-perforated imprint-receiving substrates. The multilayer imprint-receiving substrates are movable along a curved transport path. A thrust tractor pair is disposed in front of a substrate support in transport direction. At least one friction roller pair is furnished with in each case at least one driven friction roller. A pulling force can be transferred by way of said friction roller. The multilayer imprint-receiving substrate rests with its rear layer on the substrate support. The thrust tractor 5 is furnished with a braking element 19 for the front layer 8*b* of the multilayer imprint-receiving substrate 8 such that a following first friction roller pair 11 exhibits a driven friction roller 11*a*. This friction roller 11*a* rests at the front layer 8*b* of the multilayer imprint-receiving substrate 8. The friction roller 11*a* performs a slightly smaller motion path per time unit relative to a counter friction roller 11*b*. However, a counter friction roller 11*b*, resting at the rear layer 8*a*, performs a slightly larger motion path versus the tractor advance path.

The thrust tractor 5 can be disposed with the braking element 19, as seen in transport direction, in front of the first friction roller pair 11. The substrate support 2 can follow to the first friction roller pair 11. A second friction roller pair 12 can be furnished behind the substrate support 2.

A device for the transport of multilayer, edge-perforated imprint-receiving substrates with a thrust tractor is disposed in transport direction ahead and in front of a substrate support and includes at least one driven gear wheel. An endless gear belt is guided and lead over the driven gear wheel The gear belt is furnished with pins on the outside for an engagement into the imprint-receiving substrate. There is furnished a flip cover with an opening recess for the pins. The thrust tractor 5 exhibits a rough braking face 30, disposed opposite the closed flip cover 28. The rough braking surface is formed to engage the print substrate and to generate a braking force of from about 1 to 10 Newton and preferably of from about 2 to 5 Newton with a substrate width of about 30 cm. However, the flip cover 28 is furnished with a smooth surface at its support face 31 and is pressable onto the entered imprint-receiving substrate 8.

The thrust tractor 5 can exhibit, as seen in transport direction 10, a rigid guide channel 32 behind the flip cover 28. This rigid guide channel 32 can protrude beyond the engagement path of the gear belt 22. The flip cover 28 can be adapted to the curvature of a tractor body 27 with engaged gear belt 22. The rough braking face 30 can be furnished by grooves, teeth 33, or the like, running cross to the transport direction 10 of the imprint-receiving substrate 8.

The invention device is mounted on a base plate 1. The base 1, for example, is part of a frame of a printer, in particular of a matrix pin printer. A substrate support 2 is supported between side frame parts, which side frame parts are not visible in the drawing. A back and forth movable print head slider 3 is disposed in front of the substrate support 2. A print head 4 is disposed on the print head slider 3. A pair of thrust tractors 5 is disposed at the rear side la of the base plate 1. The thrust tractors 5 are supported in each case on a rotary-driven four-edge shaft 6 and on the rear side la by way of a cross-slidable protrusion 7. The four-edge shaft is preferably of square or rectangular cross-section. A band-shaped imprint-receiving substrate 8, which is edge-perforated and comprises two or more layers, is moved by way of the thrust tractor 5 on a curve-shaped transport path 9 in transport direction 10.

The transport path 9 is determined by a first friction roller pair 11, by the substrate support 2, and by a second friction roller pair 12 in addition to the above-described thrust tractor 5. The friction rollers 11*a* and 11*b* are rotary driven at the friction roller pair 11. Only one friction roller 12*b*, resting at a rear paper layer 8*a*, is driven at the second friction roller pair 12. However, in contrast, one friction roller 12*a* is not driven.

The multilayer imprint-receiving substrate 8 exhibits a rear layer 8*a*, that is in general very thin, and a front layer 8*b*, that is in general thick. The thinner rear layer 8*a* comprises in general copy paper and the thicker front layer 8*b* comprises conventional writing paper having a paper weight of, for example, from about 20 to 28 lbs, such as it is employed in typewriters and/or printers. It is also possible to employ several thin and/or thick layers 8*a*, 8*b*. Based on the production, the layers 8*a*, 8*b* are more or less bonded to each other.

The friction roller 11*a* can be set or pressed by way of an automatically controlled force, against the spatially fixed friction roller 11*b* based on a mechanism formed via a pressure spring 13 and a slider 14, a switch control shaft 15 and a spring 16. The rotary drives for the friction rollers 11*a* and 11*b* can transfer different drive forces or, respectively, rotary motions or, respectively, rotary paths to the two friction rollers 11*a* and 11*b*.

A further friction roller 17 is placed out of operation during the operation with the continuous imprint-receiving substrates 8. The further friction roller 17 is only required for a feeding of individual sheets through a single-sheet shaft 18.

The transport of the imprint-receiving substrate 8 occurs as follows in case of use of a braking element 19.

The thrust tractor 5 acts on the front layer 8*b* by way of the braking element 19. The following friction roller pairs 11 and 12 act also in a particular way on the imprint-receiving receiving substrate 8 by way of a driven friction roller 11*a* and 11*b* or, respectively, 12*b*. The friction roller 11*a* rests at the front layer 8*b* of the multilayer imprint-receiving substrate 8 and performs a slightly smaller motion path per time unit relative to the counter friction roller 11*b*. The counter friction roller 11*b* performs a slightly larger motion path relative to the thrust tractor advance. The tangential speed of the counter friction roller 11*b* can be from about 1 to 10 percent and is preferably from 3 to 6 percent faster than the tangential speed of the friction roller 11*a*. Consequently, while the front layer 8*b* of the imprint-receiving substrate 8 is braked by the braking element 19, there occurs a further braking of the front layer 8*b* by the driven friction roller 11*a*, in that the friction roller 11*b* is rotated faster, whereby a bulge of the imprint-receiving substrate 8, possibly generated in the region 20, is immediately diminished and reduced at the rear layer 8*a*.

A further, properly distributed pulling-force set-up is achieved as follows by the disposition of the individual braking members. The thrust tractor 5 with the braking element 19 is disposed in transport direction 10 in front and ahead of the first friction roller pair 11. Then, the substrate support 2 follows in transport direction 10. A second friction roller pair 12 is furnished behind the substrate support 2, wherein only the friction roller 12*b* is driven. In this case, the thinner rear layer 8*a* is now tensioned more than the thicker front layer 8*b*.

According to tests, it has been found that only a small bulge or belly and no overexertion of the edge perforation can be generated in the imprint-receiving substrate 8.

Figure 2:
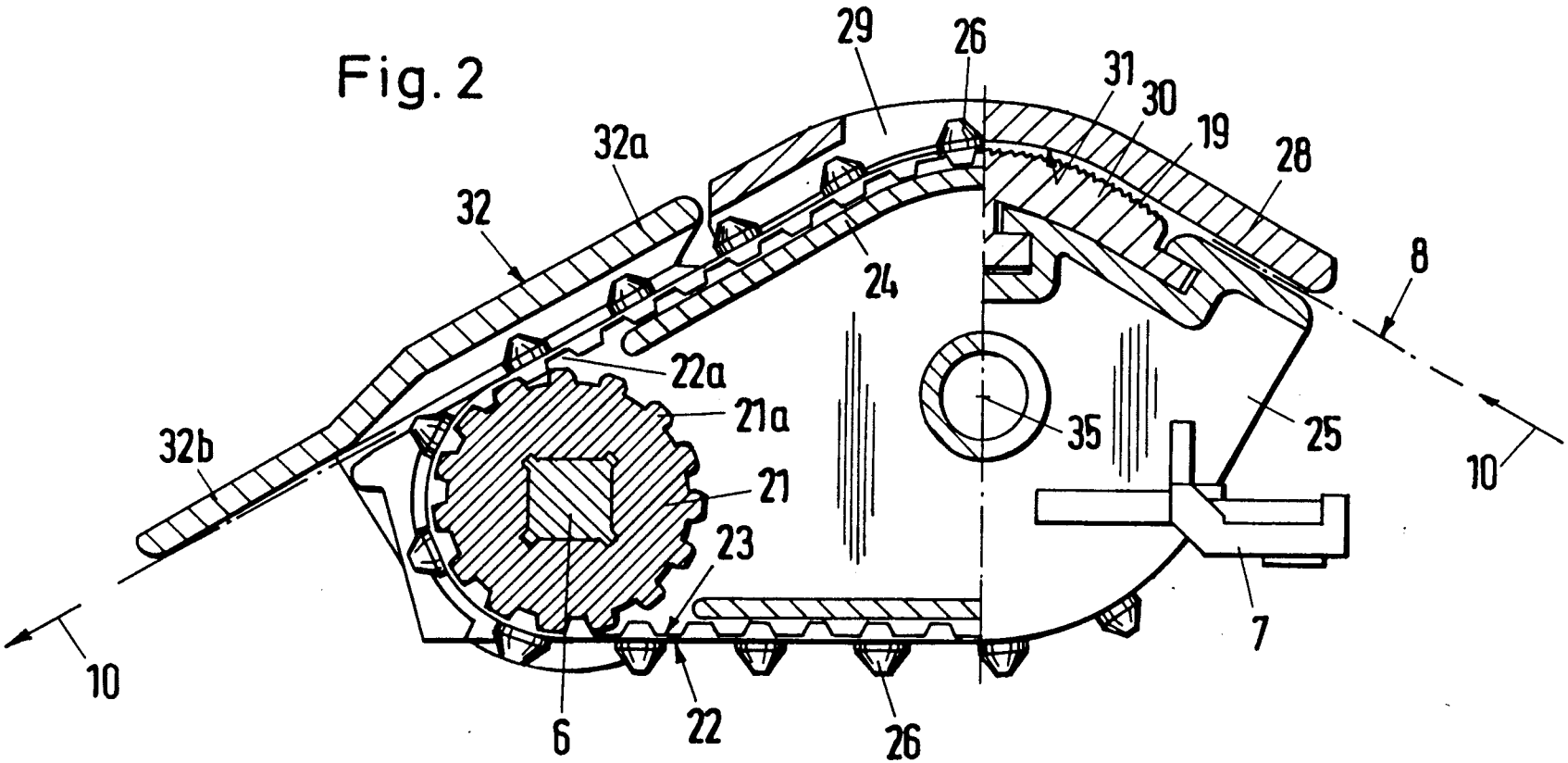
FIG. 2 is a vertical, longitudinal view through the thrust tractor at an enlarged scale.
Figure 3:
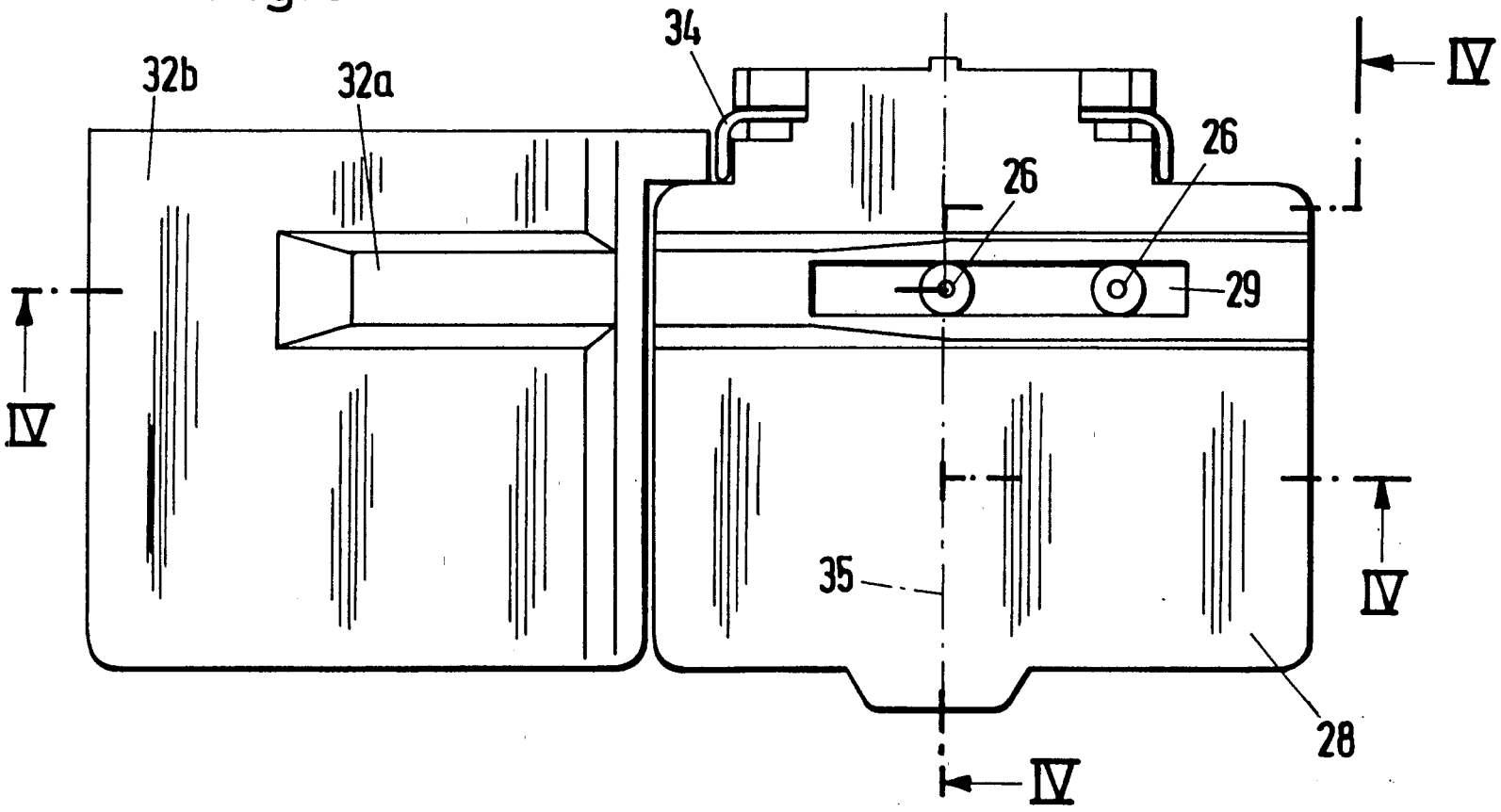
FIG. 3 is a top plan view onto the thrust tractor according to FIG. 2.
Figure 4:
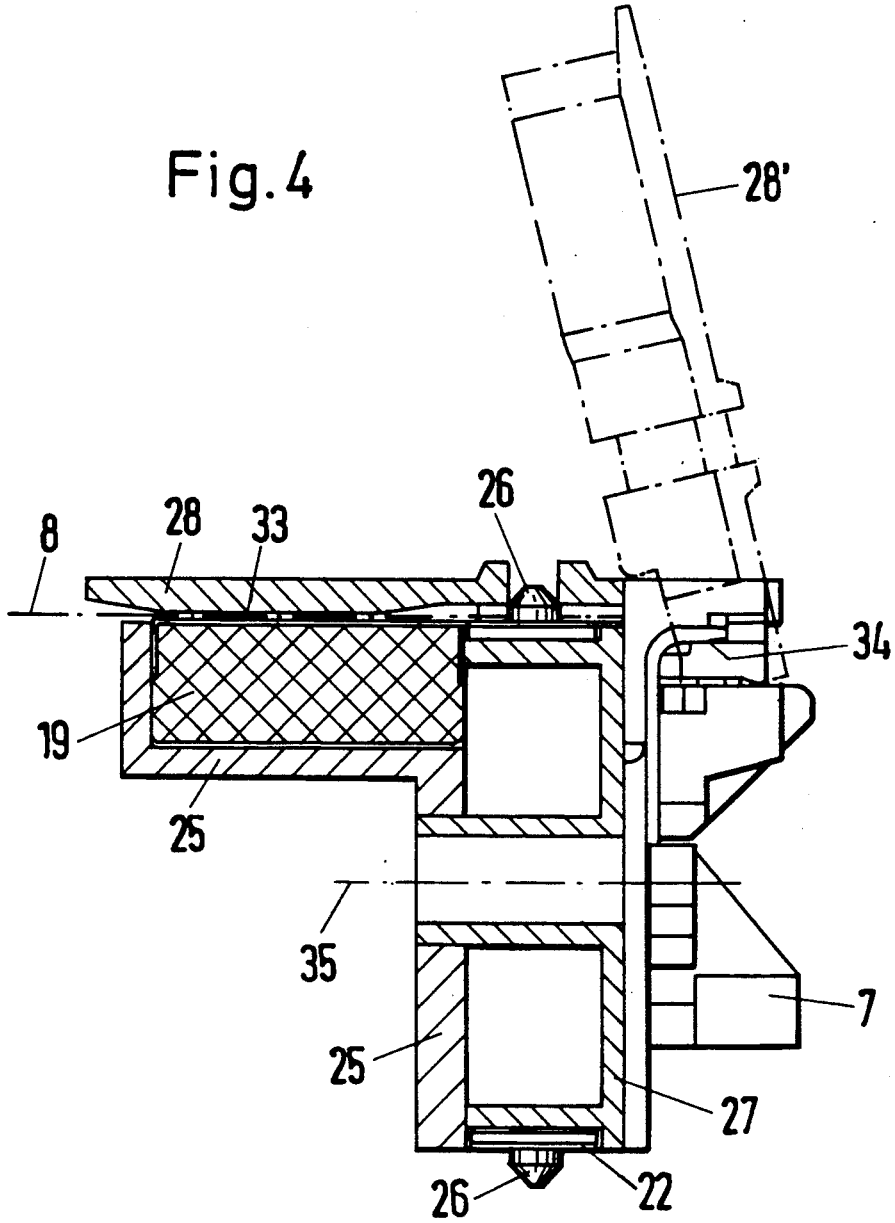
FIG. 4 is a cross-sectional view along section line IV—IV of the embodiment according to FIG. 3 through the thrust tractor.

The thrust tractor 5, as illustrated in FIG. 2, is specially designed for the transport of multilayer imprint-receiving substrates 8. The thrust tractor 5 is indicated, as implied by its name, in front of the substrate support 2. The thrust tractor 5 exhibits a driven gear wheel 21 supported on the four-edge shaft 6. A gear belt 22 is running via the gear wheel 21. The gear wheel 21 engages with its teeth 21*a* into the counter-tooth arrangement 22*a* of the gear belt 22. The counter-tooth arrangement 22*a* is disposed on the inner side 23 of the gear belt 22. During the course of the gear belt 22, the counter-tooth arrangement 22*a* is supported on a spatially fixed guide track 24, which guide track 24 is furnished at the tractor housing 25. Pins 26 are disposed at the outside of the gear belt 22. As usual in related conventional equipment, the pins 26 engage in the edge perforations of the imprint-receiving substrate 8, conventionally called Leporello paper. In addition, the gear belt 22 is guided over a tractor body 27, as illustrated in FIG. 4. The thrust tractor 5 exhibits in addition a flip cover 28 with an opening recess 29 for the pins 26.

The thrust tractor 5 with the braking element 19 now exhibits a rough braking face 30 disposed opposite the closed flip cover 28 (FIG. 2), where the braking face 30 represents the braking element 19. In contrast, the flip cover 28, pressable onto the entered and inserted imprint-receiving substrate 8, is furnished with a smooth inner support surface 31. This means that the braking face 30 exhibits a very high friction factor and that the flip cover 28 exhibits a very small friction factor at its inner support face 31. Preferably, the friction factor ratio between the rough braking face 30 and the smooth inner support surface can be from about 2 to 10, and is preferably between 3 and 5.

Furthermore, the thrust tractor 5 exhibits in transport direction 10, behind the flip cover 28, a rigid guide channel 32 protruding beyond the engagement path of the gear belt 22. This guide channel 32 reaches, as illustrated in FIG. 1, up to the region of the individual sheet shaft 18 or, respectively, of the friction roller 11*b*.

Advantageously, the flip cover 28 is adapted to the outer circumference or, respectively, the radius and to the curvature of the tractor body 27, while the gear belt 22 is in position.

The rough braking face 30 comprises grooves 33 or the like which are running cross to the transport direction 10 of the imprint-receiving substrate 8.

The guide channel 32 is formed of a slightly higher level in the first section 32*a* in the area of the pins 26. Following thereto, a second section 32*b* considers the number of the layers 8*a*, 8*b* of the imprint-receiving substrate 8.

As illustrated in FIG. 4, the flip cover 28 is supported by way of a metal bow 34 at the tractor body 27. The flip cover 28 can be flipped into a tilted position 28' over the metal bow 34.

Figure 5:
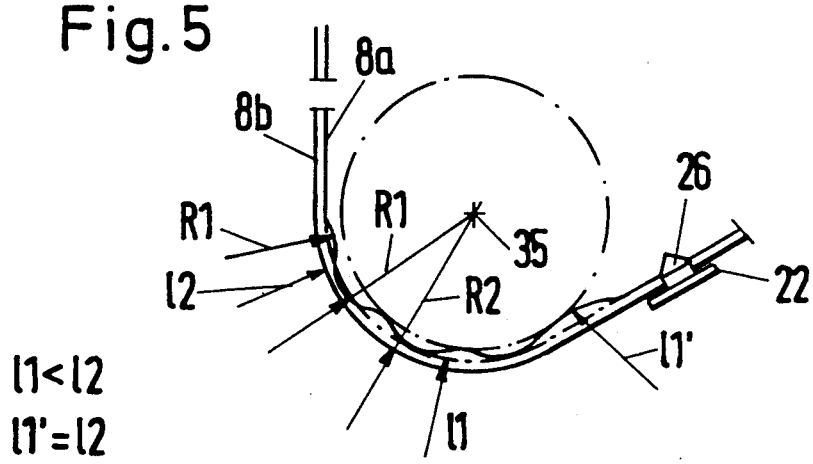
FIG. 5 is a view of a schematic and basic representation of a practical operation of the invention device in case of multilayer imprint-receiving substrates.

The relationships of the radii and of the paper lengths are also illustrated schematically in FIG. 5. The layer 8*a*, which is the thinner rear layer, is guided around the radius R1 and exhibits the paper length 11. The layer 8*b*, which is the thicker front layer, is guided around the larger radius R2 and exhibits the paper length 12. In this case, the value 11 is smaller than the value 12. During the formation of a bulge or belly, there is generated an upsetting or a jamming of the paper, which can possibly give a meandershape configuration to the paper, and which is designated with 11'. This paper length 11' is equal to the paper length 12. The situation illustrated in FIG. 5 is taken into account by the above described invention consideration.

It will be understood that each of the elements described above, or two or more together, may also find a useful application in other types of paper transport systems differing from the types described above.

While the invention has been illustrated and described as embodied in the context of a device for the transport of multilayer, edge-perforated imprint-receiving substrates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A device for the transport of multilayer, edge-perforated imprint-receiving substrates comprising a thrust tractor pair for pushing a multilayer edge-perforated imprint-receiving substrate movable along a curved transport path;

a braking element furnished at the thrust tractor for braking a front layer of the multilayer imprint receiving substrate;

a first friction roller driven by a motor and resting against the front layer of the multilayer imprint-receiving substrate;

a second friction roller resting against a rear layer of the multilayer imprint-receiving substrate and providing a counter friction roller, wherein the first friction roller and the second friction roller form a friction roller pair including at least one driven friction roller for transferring a pulling force to the multilayer imprint-receiving substrate arriving from the thrust tractor pair, and wherein the first friction roller surface performs a slightly smaller motion path with its surface engaging the front layer of the imprint-receiving substrate per time unit relative to an advance of the thrust tractor advance motion, and wherein the second friction roller surface resting at the rear layer of the imprint-receiving substrate performs a slightly larger motion path versus the tractor advance motion;

a substrate support, wherein the multilayer imprint-receiving substrate, arriving from the friction roller pair, rests with its rear layer on the substrate support.

2. The device according to claim 1, wherein the first friction roller surface performs a motion path with its surface, engaging the front layer of the imprint-receiving substrate per time unit, which is at least about one percent smaller relative to the thrust tractor advance motion.

3. The device according to claim 2, wherein the first friction roller surface performs a motion path with its surface, engaging the front layer of the imprint-receiving substrate per time unit, which is at least about three percent smaller relative to the thrust tractor advance motion.

4. The device according to claim 1, wherein the second friction roller surface, resting at the rear layer of the imprint-receiving substrate, performs a motion path at least one percent larger than the tractor advance motion path.

5. The device according to claim 1, wherein the second friction roller surface, resting at the rear layer of the imprint-receiving substrate, performs a motion path at least three percent larger than the tractor advance motion path.

6. The device according to claim 1, further comprising a print head disposed adjacent to the front layer of the multilayer imprint-receiving substrate immediately opposite to the substrate support.

7. The device according to claim 6, further comprising a third friction roller, wherein the front layer of the multilayer imprint-receiving substrate, arriving from the print head, contacts a surface of the third friction roller;

a fourth friction roller, wherein the rear layer of the multilayer imprint receiving substrate, arriving from the substrate support, contacts a surface of the fourth friction roller, and wherein the third friction roller and the fourth friction roller form a friction roller pair.

8. The device according to claim 1, further comprising a flip cover for the thrust tractor disposed next to the rear layer of the multilayer imprint-receiving substrate, wherein the braking element, furnished at the thrust tractor for braking the front layer of the multilayer imprint-receiving substrate, exerts a braking force which is at least two times the braking force generated by the flip cover on the rear layer of the multilayer imprint-receiving substrate.

9. A device for the transport of multilayer, edge-perforated imprint-receiving substrates comprising a flip cover having a support face for a rear layer of a multilayer imprint-receiving substrate, wherein the flip cover is furnished smooth at said support face and exhibits an opening recess;

a thrust tractor including at least one driven gear wheel and closable by the flip cover and exhibiting a rough braking face disposed opposite the closed flip cover, wherein the flip cover is pressable onto the rear layer of the passing imprint-receiving substrate;

an endless gear belt guided and lead over the driven gear wheel, wherein the gear belt is furnished with pins on the outside for an engagement into the imprint-receiving substrate, and wherein the opening recess of the flip cover surrounds the pins.

10. The device according to claim 9, wherein the thrust tractor forms a rigid guide channel disposed behind the flip cover, which rigid guide channel ranges beyond the engagement path of the gear belt.

11. The device according to claim 10, wherein the thrust tractor is curved for deflecting the path direction of the multilayer imprint-receiving substrate, and wherein the flip cover is adapted to the curvature of a tractor body with engaged gear belt.

12. The device according to claim 9 further comprising friction engagement means disposed in the braking face of the thrust tractor and furnishing roughness and disposed aligned for extending longitudinally in a direction perpendicular to the transport advance direction of the imprint-receiving substrate.

13. The device according to claim 9, wherein the rough braking face of the thrust tractor, for braking the front layer of the multilayer imprint-receiving substrate, exerts a braking force which is at least two times the braking force generated by the flip cover on the rear layer of the multilayer imprint-receiving substrate.

14. A device for the transport of multilayer, edge-perforated imprint-receiving substrates, which are movable along a curved transport path, with a thrust tractor pair disposed in front of a substrate support in transport direction, as well as with at least one friction roller pair with in each case at least one driven friction roller, by way of which friction roller a pulling force can be transferred, wherein the multilayer imprint-receiving substrate rests with its rear layer on the substrate support, wherein the thrust tractor (5) is furnished with a braking element (19) for the front layer (**8*b*) of the multilayer imprint-receiving substrate (8) such that a following first friction roller pair (11) exhibits a driven friction roller (11*a*), which friction roller (11*a*) rests at the front layer (8*b*) of the multilayer imprint-receiving substrate (8), and which friction roller (11*a*) performs a slightly smaller motion path per time unit relative to a counter friction roller (11*b*), wherein however a counter friction roller (11*b*), resting at the rear layer (8*a***), performs a slightly larger motion path versus the tractor advance path.

15. The device according to claim 14, wherein the thrust tractor (5) is disposed with the braking element (19), as seen in transport direction, in front of the first friction roller pair (11), wherein the substrate support (2) follows to the first friction roller pair (11), and wherein a second friction roller pair (12) is furnished behind the substrate support (2).

16. A device for the transport of multilayer, edge-perforated imprint-receiving substrates with a thrust tractor, which is disposed in transport direction ahead and in front of a substrate support, and which includes at least one driven gear wheel, where an endless gear belt is guided and lead over the driven gear wheel, where the gear belt is furnished with pins on the outside for an engagement into the imprint-receiving substrate, and wherein there is furnished a flip cover with an opening recess for the pins, wherein the thrust tractor (5) exhibits a rough braking face (30), disposed opposite the closed flip cover (28), where, however, the flip cover (28) is furnished smooth at its support face (31) and is pressable onto the entered imprint-receiving substrate (8).

17. The device according to claim 16, wherein the thrust tractor (5) exhibits, as seen in transport direction (10), a rigid guide channel (32) behind the flip cover (28), which rigid guide channel (32) protrudes beyond the engagement path of the gear belt (22).

18. The device according to claim 17, wherein the flip cover (28) is adapted to the curvature of a tractor body (27) with engaged gear belt (22).

19. The device according to claim 16, wherein the rough braking face (30) is furnished by grooves, teeth (33), or the like, running cross to the transport direction (10) of the imprint-receiving substrate (8).

20. A method for the transport of multilayer, edge-perforated imprint-receiving substrates comprising pushing the multilayer imprint-receiving substrates with a thrust tractor pair along a curved transport path;

braking a front layer of the multilayer imprint receiving substrate with a braking element furnished at the thrust tractor;

driving a first friction roller with a motor;

advancing the front layer of the multilayer imprint-receiving substrate arriving from the thrust tractor with the first friction roller;

pressing against a rear layer of the multilayer imprint-receiving substrate with a second friction roller providing a counter friction roller, while the first friction roller and the second friction roller form a friction roller pair, including at least one driven friction roller for transferring a pulling force to the multilayer imprint-receiving substrate arriving from the thrust tractor pair, and wherein the first friction roller surface performs a slightly smaller motion path with its surface engaging the front layer of the imprint-receiving substrate per time unit relative to an advance of the thrust tractor advance motion, and wherein the second friction roller surface resting at the rear layer of the imprint-receiving substrate performs a slightly larger motion path versus the tractor advance motion;

guiding the multilayer imprint-receiving substrate from the friction roller pair to a substrate support, wherein the multilayer imprint-receiving substrate arriving from the friction roller pair contacts the substrate support with its rear layer.

* * * * *